US012359813B2

(12) United States Patent
Naik et al.

(10) Patent No.: US 12,359,813 B2
(45) Date of Patent: Jul. 15, 2025

(54) ENGINE FUEL NOZZLE AND SWIRLER

(71) Applicant: General Electric Company, Schenectady, NY (US)

(72) Inventors: Pradeep Naik, Bengaluru (IN); Perumallu Vukanti, Bengaluru (IN); Michael T. Bucaro, Arvada, CO (US); Ajoy Patra, Bengaluru (IN); Manampathy G. Giridharan, Evendale, OH (US); Steven C. Vise, West Chester, OH (US); Michael A. Benjamin, West Chester, OH (US); Sripathi Mohan, Bengaluru (IN); R Narasimha Chiranthan, Bengaluru (IN); Joseph Zelina, Waynesville, OH (US)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 17/691,781

(22) Filed: Mar. 10, 2022

(65) Prior Publication Data

US 2023/0204213 A1 Jun. 29, 2023

Related U.S. Application Data

(60) Provisional application No. 63/294,593, filed on Dec. 29, 2021.

(51) Int. Cl.

| | |
|---|---|
| ***F23R 3/14*** | (2006.01) |
| ***F23R 3/28*** | (2006.01) |
| *F23D 11/38* | (2006.01) |

(52) U.S. Cl.

CPC ..... *F23R 3/14* (2013.01); *F23R 3/286* (2013.01); *F23D 11/383* (2013.01); *F23D 2900/14701* (2013.01)

(58) Field of Classification Search

CPC ..... F23R 3/14; F23R 3/286; F23D 11/383; F23D 2900/14701; F23D 11/103; F23D 14/24; F23D 2900/14021

See application file for complete search history.

(56) References Cited

U.S. PATENT DOCUMENTS 3,913,845 A * 10/1975 Tsuji ..... F02M 67/10 239/524
4,408,461 A 10/1983 Bruhwiler et al.
(Continued)

FOREIGN PATENT DOCUMENTS

CN 103363524 10/2013
DE 920720 C 11/1954
(Continued)

OTHER PUBLICATIONS

English Translation of EP 2442026 A1 (Year: 2012).*
(Continued)

*Primary Examiner* — Gerald L Sung
*Assistant Examiner* — Jacek Lisowski
(74) *Attorney, Agent, or Firm* — Carter, DeLuca & Farrell LLP

(57) ABSTRACT

A turbine engine can utilize a combustor to combust fuel to drive the turbine, which drives the engine. A fuel nozzle assembly can supply fuel to the combustor for combustion or ignition of the fuel. The fuel nozzle assembly can include a swirler and a fuel nozzle to supply a mixture of fuel and air for combustion. Increasing efficiency and carbon-containing emission needs benefit from the use of alternative fuels, which combust at higher temperatures than traditional fuels, requiring improved fuel introduction without the occurrence of flame holding or flashback.

19 Claims, 14 Drawing Sheets

(56) References Cited

U.S. PATENT DOCUMENTS

| | | | | |
|---|---|---|---|---|
| 5,622,489 | A * | 4/1997 | Monro | F23C 7/004 239/492 |
| 5,860,600 | A * | 1/1999 | Schindler | F23D 11/383 239/558 |
| 6,367,262 | B1 | 4/2002 | Mongia et al. | |
| 6,622,944 | B1 * | 9/2003 | Hurley | F23D 11/38 239/560 |
| 7,017,329 | B2 | 3/2006 | Farhangi et al. | |
| 7,343,745 | B2 | 3/2008 | Inoue et al. | |
| 7,824,165 | B2 | 11/2010 | Davie et al. | |
| 8,205,452 | B2 | 6/2012 | Boardman et al. | |
| 8,266,911 | B2 | 9/2012 | Evulet | |
| 10,865,989 | B2 | 12/2020 | Sadasivuni | |
| 11,054,137 | B2 | 7/2021 | Choi | |
| 11,085,643 | B2 | 8/2021 | Freeman et al. | |
| 2010/0162716 | A1 | 7/2010 | Bastnagel et al. | |
| 2010/0275604 | A1 | 11/2010 | Hall | |
| 2010/0300102 | A1 * | 12/2010 | Bathina | F23R 3/12 60/737 |
| 2011/0162379 | A1 * | 7/2011 | Baruah | F23R 3/286 60/39.463 |
| 2011/0185703 | A1 * | 8/2011 | Dodo | F23R 3/34 60/39.461 |
| 2012/0151928 | A1 | 6/2012 | Patel et al. | |
| 2014/0109582 | A1 | 4/2014 | Shershnyov et al. | |
| 2015/0000299 | A1 * | 1/2015 | Zuo | E21B 43/166 60/776 |
| 2016/0010864 | A1 * | 1/2016 | Abe | F23R 3/32 60/748 |
| 2016/0290646 | A1 * | 10/2016 | Abe | F23R 3/04 |
| 2017/0307218 | A1 * | 10/2017 | Miyauchi | F23R 3/286 |
| 2019/0032559 | A1 | 1/2019 | Dai et al. | |
| 2019/0137103 | A1 * | 5/2019 | Choi | F23R 3/16 |

FOREIGN PATENT DOCUMENTS

| | | | | |
|---|---|---|---|---|
| EP | 2442026 | A1 * | 4/2012 | F23C 7/002 |
| WO | 2013/065624 | A1 | 5/2013 | |

OTHER PUBLICATIONS

Chinese Office Action issued in corresponding Chinese Application No. 202211055026.7 dated Mar. 29, 2025, 24 pages.

Chinese Office Action issued in corresponding Chinese Application No. 202211055026.7 dated Mar. 29, 2025, 13 pages.

European Communication Pursuant to Article 94(3) EPC issued in corresponding European Application No. 22 186 590.0 dated May 7, 2025, 6 pages.

* cited by examiner

ENGINE FUEL NOZZLE AND SWIRLER

CROSS-REFERENCE TO RELATED APPLICATION(S)

This application claims priority to and the benefit of U.S. Provisional Patent App. No. 63/294,593, filed Dec. 29, 2021, the entirety of which is incorporated herein by reference.

FIELD

The present subject matter relates generally to an engine component having one or both of a fuel nozzle and a swirler located in an engine.

BACKGROUND

An engine, such as a turbine engine, includes a turbine that is driven by combustion of a combustible fuel within a combustor of the engine. The engine utilizes a fuel nozzle to inject the combustible fuel into the combustor. A swirler provides for mixing the fuel with air in order to achieve efficient combustion.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
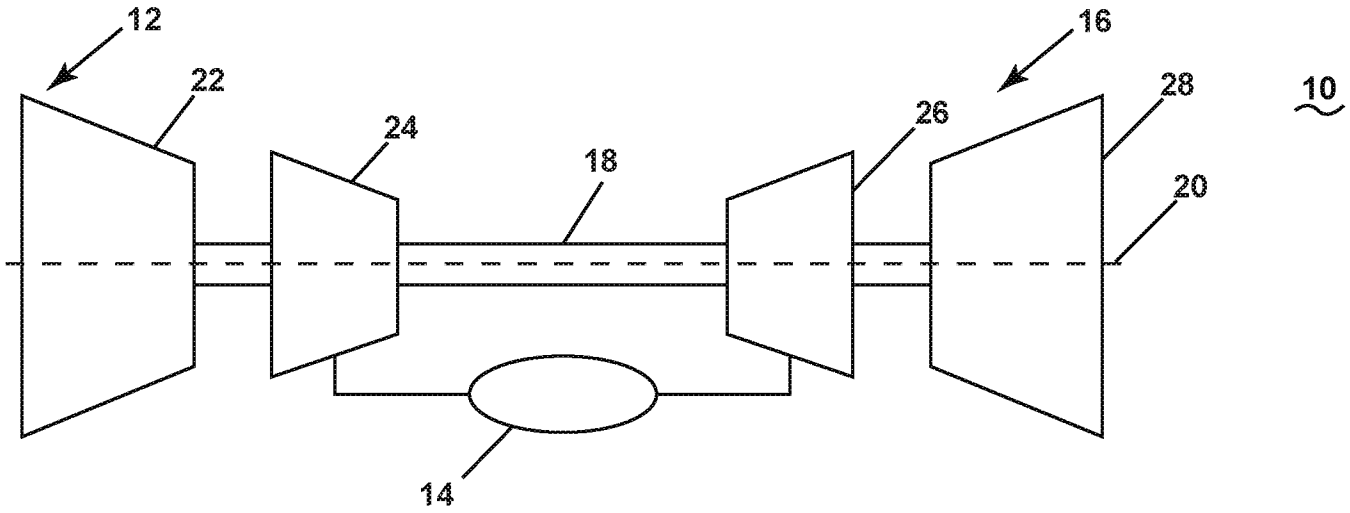
FIG. 1 is a schematic cross-sectional view of an engine in accordance with an exemplary embodiment of the present disclosure.

Aspects of the disclosure herein are directed to a fuel nozzle and swirler architecture located within an engine component, and more specifically to a fuel nozzle structure configured for use with heightened combustion engine temperatures, such as those utilizing a hydrogen fuel. Hydrogen fuels can eliminate carbon emissions, but generate challenges relating to flame holding due to the higher flame speed. Current combustors include a durability risk when using such fuels or other high-temperature fuels due to flame holding on combustor components resultant of flashback. For purposes of illustration, the present disclosure will be described with respect to a turbine engine for an aircraft with a combustor driving the turbine. It will be understood, however, that aspects of the disclosure herein are not so limited and may have general applicability within an engine, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

Reference will now be made in detail to the fuel nozzle and swirler architecture, one or more examples of which are illustrated in the accompanying drawings. The detailed description uses numerical and letter designations to refer to features in the drawings. Like or similar designations in the drawings and description have been used to refer to like or similar parts of the disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

The term "flame holding" relates to the condition of continuous combustion of a fuel such that a flame is maintained along or near to a component, and usually a portion of the fuel nozzle assembly as described herein, and the term "flashback" relate to a retrogression of the combustion flame in the upstream direction.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

Approximating language, as used herein throughout the specification and claims, is applied to modify any quantitative representation that could permissibly vary without resulting in a change in the basic function to which it is related. Accordingly, a value modified by a term or terms, such as "about", "approximately", "generally", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

In certain exemplary embodiments of the present disclosure, a turbine engine defining a centerline and a circumferential direction is provided. The turbine engine may generally include a turbomachine and a rotor assembly. The rotor assembly may be driven by the turbomachine. The turbomachine, the rotor assembly, or both may define a substantially annular flowpath relative to the centerline of the turbine engine. The turbine engine includes a combustor positioned upstream of the turbine configured to drive the turbine.

The combustor introduces fuel from a fuel nozzle, which is mixed with air provided by a swirler, and then combusted within the combustor to drive the turbine. Increases in efficiency and reduction in emissions have driven the need to use fuel that burns cleaner or at higher temperatures, such as utilizing hydrogen fuel. There is a need to improve durability of the combustor under these operating parameters, such as improved flame control to prevent flame holding on the fuel nozzle and swirler components.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16. A drive shaft 18 rotationally couples the compressor and turbine sections 12, 16, such that rotation of one affects the rotation of the other, and defines a rotational axis 20 for the turbine engine 10.

The compressor section 12 can include a low-pressure (LP) compressor 22, and a high-pressure (HP) compressor 24 serially fluidly coupled to one another. The turbine section 16 can include an LP turbine 28, and an HP turbine 26 serially fluidly coupled to one another. The drive shaft 18 can operatively couple the LP compressor 22, the HP compressor 24, the LP turbine 28 and the HP turbine 26 together. Alternatively, the drive shaft 18 can include an LP drive shaft (not illustrated) and an HP drive shaft (not illustrated). The LP drive shaft can couple the LP compressor 22 to the LP turbine 28, and the HP drive shaft can couple the HP compressor 24 to the HP turbine 26. An LP spool can be defined as the combination of the LP compressor 22, the LP turbine 28, and the LP drive shaft such that the rotation of the LP turbine 28 can apply a driving force to the LP drive shaft, which in turn can rotate the LP compressor 22. An HP spool can be defined as the combination of the HP compressor 24, the HP turbine 26, and the HP drive shaft such that the rotation of the HP turbine 26 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 26 at a downstream end of the combustion section 14.

During operation of the turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 26, which drives the HP compressor 24. The combustion gases are discharged into the LP turbine 28, which extracts additional work to drive the LP compressor 22, and the exhaust gas is ultimately discharged from the turbine engine 10 via an exhaust section (not illustrated) downstream of the turbine section 16. The driving of the LP turbine 28 drives the LP spool to rotate the fan (not illustrated) and the LP compressor 22. The pressurized airflow and the combustion gases can together define a working airflow that flows through the fan, compressor section 12, combustion section 14, and turbine section 16 of the turbine engine 10.

Figure 2:
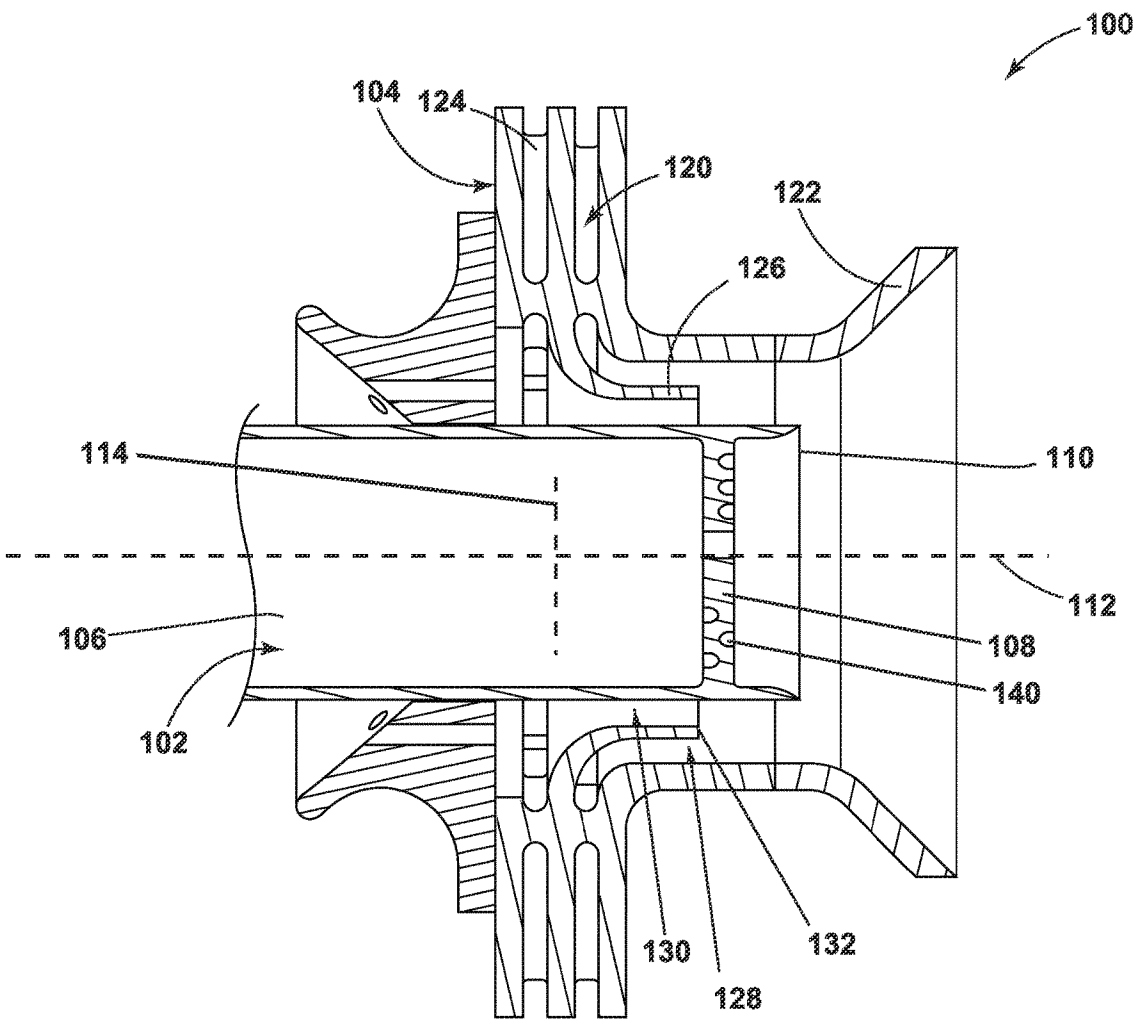
FIG. 2 is a cross section view of a fuel nozzle and swirler for use with the engine of FIG. 1 in accordance with an exemplary embodiment of the present disclosure.

FIG. 2 illustrates a fuel nozzle assembly 100 including a fuel nozzle 102 and a swirler 104 provided annularly about the fuel nozzle 102. A dome (not shown) may be provided forward of and adjacent to the swirler 104. The fuel nozzle 102 includes a nozzle supply passage 106, a fuel nozzle cap 108, and a nozzle outlet 110. The nozzle cap 108 can include a set of openings 140 permitting fuel to exhaust from the nozzle supply passage 106. The swirler 104 includes a swirler supply passage 120 at least partially circumscribing the fuel nozzle 102, and exhausting to a flare cone 122. A set of swirler vanes 124 are provided within the swirler supply passage 120 to impart a tangential or helical swirl to the air provided by the swirler 104. A splitter 126 extends from the swirler vanes 124 to separate airflow within the swirler supply passage 120 into two swirling air streams contained within an outer diameter passage 128 and an inner diameter passage 130 defined by the splitter 126. The splitter 126 extends axially to a downstream end 132, such that the downstream end 132 is coaxial with the fuel nozzle supply passage 106 or the rotational axis 20 of FIG. 1, while it is contemplated that an angular offset exists for the downstream end 132 relative to the fuel nozzle supply passage 106 or relative to a longitudinal axis 112 defined by the fuel nozzle 102, the swirler 104, or a longitudinal axis defined by the combustion section 14 containing the fuel nozzle assembly 100. Such an offset can be used to impart a directionality to the combusted fuel, relative to the longitudinal extent of the fuel nozzle 102. Additionally, the fuel nozzle 102 can be cylindrical, such that a radial axis 114 can be defined perpendicular to the longitudinal axis 112.

Figure 3:
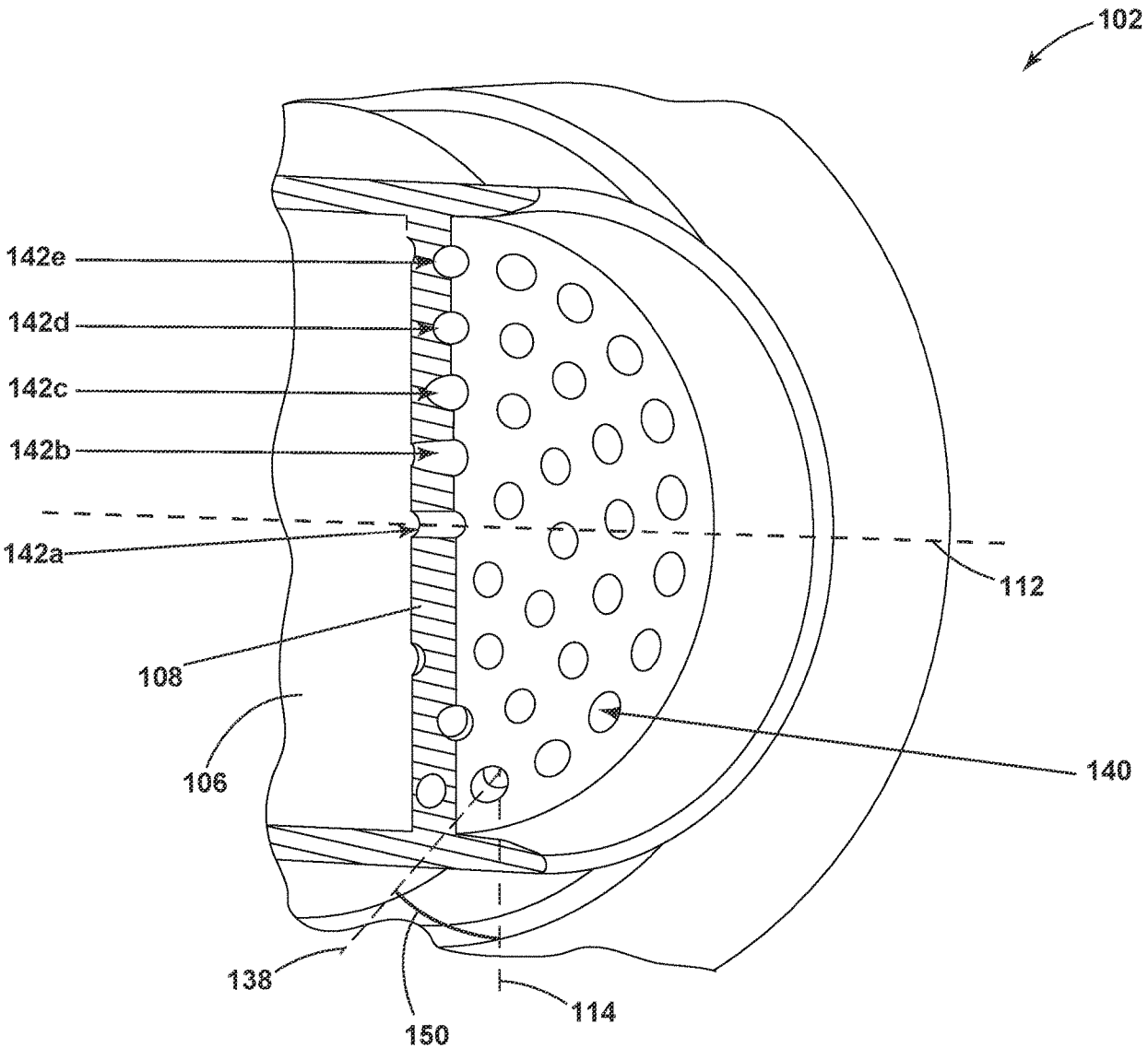
FIG. 3 is an enlarged, perspective view of a cross section of the fuel nozzle of FIG. 2 including a set of openings in accordance with an exemplary embodiment of the present disclosure.

Turning to FIG. 3, illustrated is a portion of the fuel nozzle 102 including the set of openings 140 provided in the fuel nozzle cap 108. The openings 140 can be arranged, for example, in circumferential rows of openings 142*a-e*, which are defined circumferentially relative to axial extent of the fuel nozzle supply passage 106 or the longitudinal axis 112, while suitable alternative arrangements are contemplated. Each opening 140 can include a tangential component, having a centerline 138 arranged as a tangential angle 150, such that a swirl or helical component is applied to fuel supplied through the fuel nozzle cap 108. The tangential angle 150 can be defined relative to the longitudinal axis 112, an axis parallel to the longitudinal axis 112, or to a radius extending from the longitudinal axis 112. Additionally, the tangential angle 150 of each opening 140, or each row of openings 142*a-e*, can be specified. More specifically, the tangential component for openings 140 or a row of openings 142*e* near the outer diameter of the fuel nozzle cap 108 can impart an increased swirl relative to the openings 140 or rows of openings 142*a-d* which are interior of the outer diameter row of openings 140*e*, but utilizing an increasing tangential angle 150 to impart increasing swirl. For example, the tangential angle 150 of the openings 140 can increase in a direction extending radially outward from the longitudinal axis 112. More specifically, the tangential angle 150 for each row of openings 142*a-d* can increase the further from the longitudinal axis 112 the rows of openings 142*a-d* are positioned. In another non-limiting example, a center or central opening 142*a* relative to the fuel nozzle cap 108 can also have no tangential component, such as being coaxial with the fuel nozzle supply passage 106, which can push central recirculation from the swirler further aft, which can further reduce or eliminate flame holding or flashback. The tangential angle of each opening can increase in a direction extending radially outward from a center of the fuel nozzle cap 108, such that openings further from the longitudinal axis 112 have a greater tangential angle 150 than openings nearer to the longitudinal axis 112. In another non-limiting example, the openings 140 nearer to the center of the fuel nozzle cap 108 can be smaller, such as having a smaller cross-sectional area, relative to openings 140 nearer to the outer diameter of the fuel nozzle cap 108, which can provide for reducing or eliminating jet flapping. Different cross-sectional profiles for the openings 140 are further contemplated, such as circular, slot, oval, elliptical, or racetrack in non-limiting examples. It is further contemplated that the shapes can vary based upon the radial relation to the center of the fuel nozzle cap 108, such that the shape varies based upon radial position.

Figure 4:
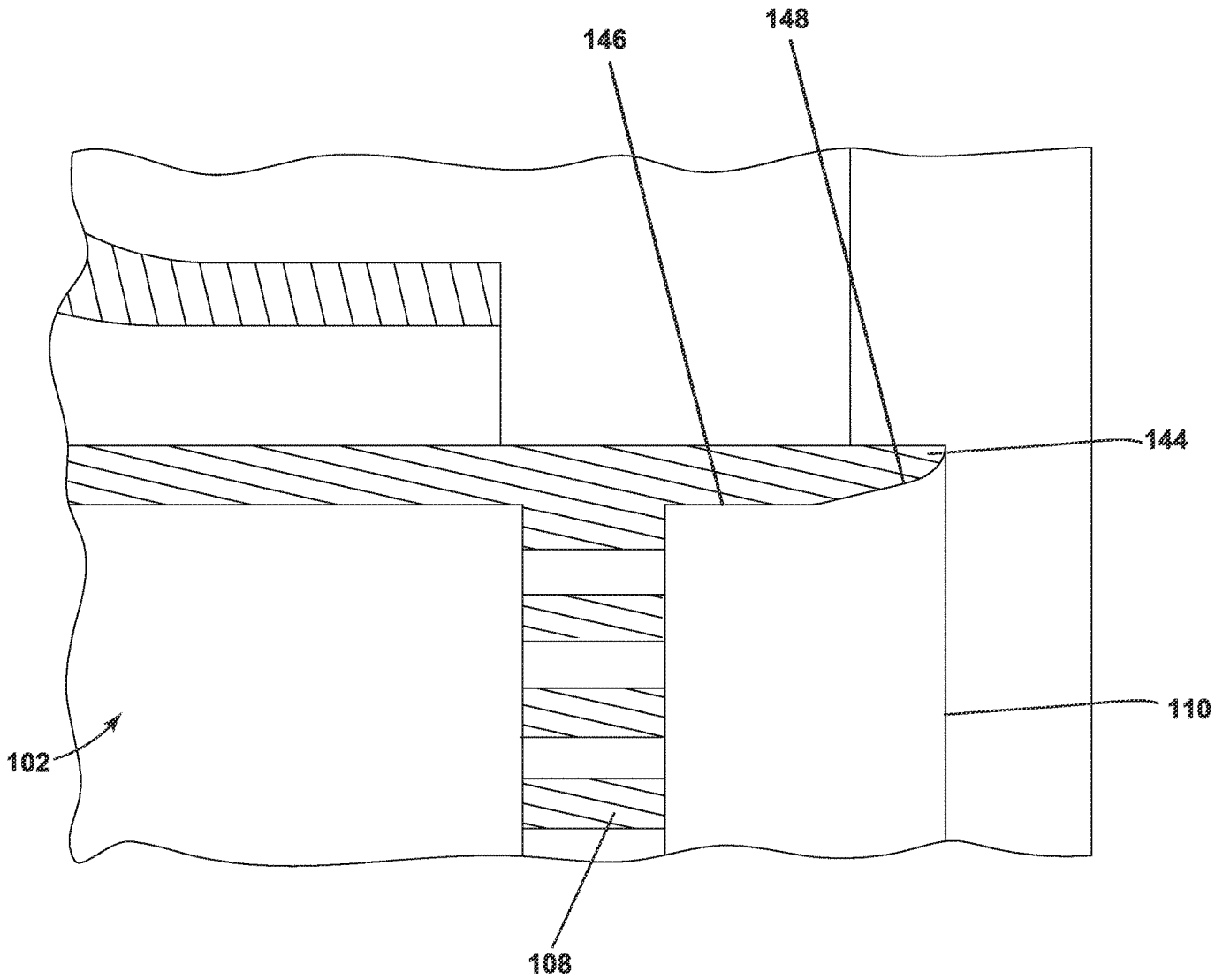
FIG. 4 is an enlarged cross-sectional view of an outlet of the fuel nozzle of FIGS. 2 and 3 in accordance with an exemplary embodiment of the present disclosure.

Turning to FIG. 4, a fuel nozzle lip 144 is provided at the nozzle outlet 110 downstream of the fuel nozzle cap 108. The fuel nozzle lip 144 includes an axial portion 146 and a diverging portion 148 extending from the axial portion 146. The axial portion 146 defines a constant cross-sectional area downstream of the fuel nozzle cap 108, and can be coaxial with the fuel nozzle 102. The diverging portion 148 defines an increasing or diverging cross-sectional area. In an alternative example, the nozzle outlet 110 can be formed as converging, diverging, constant, or any combination thereof, which can be defined by linear, curved, or discrete wall geometries defining the nozzle outlet 110, or combinations thereof. The radiused tip of the fuel nozzle lip 144 provides for reducing flow recirculation at the end of the nozzle outlet 110, which can eliminate stagnation points and flame holding.

Referring to FIGS. 2-4, in operation, a supply of air is provided via the swirler 104 and a supply of fuel is provided via the fuel nozzle supply passage 106. The supply of air provided via the swirler 104 is imparted with a tangential, swirling, or helical component by the swirler vanes 124, and separated into two flows by the splitter 126. The flows are formed as an inner diameter flow and an outer diameter flow, relative to a radius extending from the longitudinal axis 112 of the fuel nozzle supply passage 106. The two flows separated by the splitter 126 can swirl in the same direction to minimize any shear between the inner diameter flow and the outer diameter flow, while counter-flow is contemplated where increased mixing or turbulence may be advantageous.

Similarly, fuel provided from the fuel nozzle 102 is provided with a tangential or swirling component via the set of openings 140 in the fuel nozzle cap 108. The direction of the swirl imparted by the fuel nozzle 102 can be the same direction as that of the air provided by the swirler 104 to reduce or avoid any shear defined between the fuel and the air, while counter flows are contemplated to increase fuel-air mixture. In one example, the tangential component for the openings 140 can be related to the tangential component imparted by the swirler 104. For example, the tangential angles among the two can be complementary, in order to further reduce shear among the different flows. Alternatively, a counter-flow is contemplated where it can be desirable to generate increased mixing between the air and the fuel. The axial portion 146 provides for improved consistency for the velocity profile to maintain a high axial velocity, which can prevent flame holding on the fuel nozzle outlet 110. As the fuel is emitted from the nozzle outlet 110, the diverging portion 148 at the fuel nozzle lip 144 permits the fuel flow to expand which reduces or eliminates low velocity regions on the nozzle lip 144, which reduces or eliminates flame holding on the fuel nozzle 102 or swirler 104 hardware.

Co-swirl among the streams of fuel and air can reduce or avoid high shear between the streams. Reduction of the shear reduces the shear layer deficit between the airflow and the fuel flow. The reduction of this deficit can provide for improved distribution for the radial velocity profile, which can provide for maintaining a high axial velocity for both the fuel and the airflow. The high axial velocity reduces or eliminates the occurrence of flame holding and flashback on the fuel nozzle assembly 100, permitting the use of higher temperature fuels, such as hydrogen fuels, which can reduce or eliminate carbon emissions. Additionally, the co-swirling of the air and the fuel deters mixing of the air and fuel which provides for greater mixing control, as well as the further reduction or elimination of flashback and flame holding under high-temperature operations.

The splitter 126 provides for improved velocity distribution and control thereof, prior to introduction of the air flow to the fuel flow. The improved velocity distribution provides for preventing flame holding on the fuel nozzle 102, swirler 104, or flare cone 122. The constant area along the splitter 126 that is coaxial with the fuel nozzle supply passage 106 provides for improved flow development for the swirling airflow, which reduces or eliminates the occurrence of a low velocity region created by the splitter 126. The fuel is introduced downstream of the swirler 104 to prevent flame holding against the swirler 104. Similarly, the swirl created by the tangential openings 140 on the fuel nozzle cap 108 can reduce or avoid the occurrence of low velocity on the fuel nozzle outer diameter, which can reduce the opportunity for flame holding or flashback on the fuel nozzle 102.

The fuel nozzle lip 144 is arranged downstream of the fuel nozzle cap 108 to reduce the mixture of air and fuel before the fuel nozzle lip 144, and further reduces the generation of recirculation zones in the region where the air and the fuel streams mix. The fuel nozzle cap 108 provides for imparting tangential swirl to the fuel supply, while the axial portion 146 and the diverging portion 148 provide a well-defined velocity profile for the fuel supply before the fuel is introduced to the air from the swirler 104, while reducing or eliminating recirculation zones.

The features included herein provide for improved fuel supply to a turbine engine combustor, which provides for reducing or eliminating flame holding or flashback at the fuel nozzle assembly 100. Such reduction or elimination provides for the use of higher temperature fuels, such as hydrogen fuels, which provide for improving or maintaining efficiency while reducing or eliminating emissions.

Figure 5:
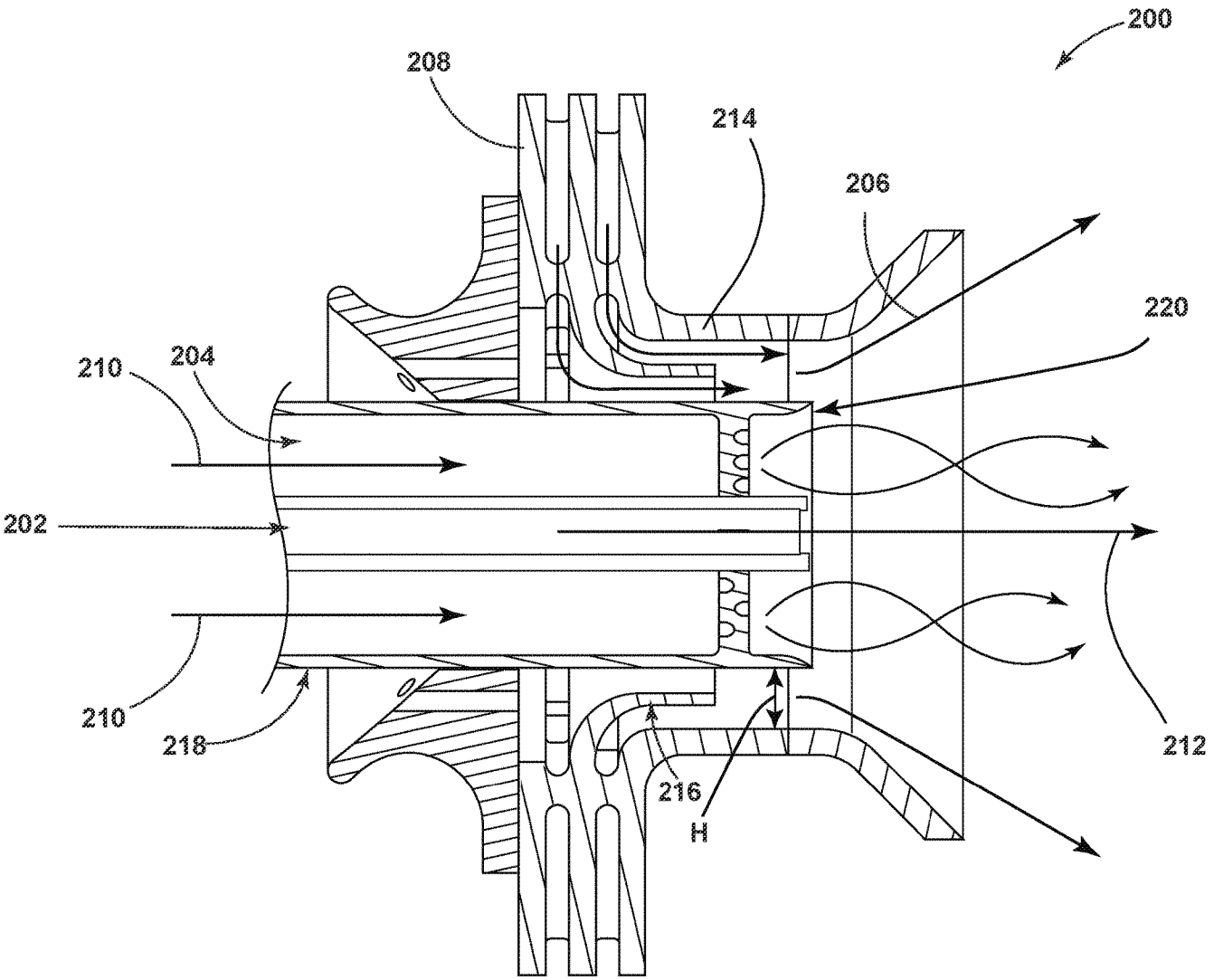
FIG. 5 is a cross section of an alternative fuel nozzle and swirler for the engine of FIG. 1 in accordance with an exemplary embodiment of the present disclosure.

Turning to FIG. 5, an alternative fuel nozzle assembly 200 is provided. The fuel nozzle assembly 200 includes a central passage 202 provided within a fuel supply passage 204, and can be coaxial with one another, for example. In this way, the fuel nozzle assembly 200 includes three supply lines, including an outer supply 206 provided by a swirler 208, a fuel supply 210 provided by the fuel supply passage 204, and a central supply 212 provided by the central passage 202. In one example, air can be provided within the central passage 202, while other fluids or materials are contemplated, such as fuel, fuel mixes, or diluents. The fluid within the central passage 202 can have a swirl or helical component, such as imparted by a swirler or vane, or can be provided as non-swirling or laminar flow, in additional non-limiting examples.

Additionally, each of the central supply 212 and the outer supply 206 can be either swirling or non-swirling. In one example, all three supplies 206, 210, and 212 can be imparted with a swirling component in the same direction in order to decrease shear between the different flows. Alternatively, only the central passage 202 can be non-swirling, which can provide for moving any recirculation zone aft or downstream of the end of the fuel supply passage 204, which can reduce or eliminate flame holding and flashback. In another example, fuel provided from the fuel supply 210 can be provided between outer swirling air in the outer supply 206, and inner non-swirling air within the central passage 202, which provides for improved fuel and air mixing downstream of the fuel supply passage 204. In yet another example, the central passage 202 can be used as a pilot or for introducing other materials, such as diluents for nitrogen oxide suppression in one non-limiting example. It should be appreciated that the differing use of swirling or non-swirling airflows can be utilized to define a velocity profile for the fuel and air being provided, which can be utilized to reduce or eliminate the occurrence of flame holding or flashback at the fuel nozzle assembly 200, permitting the use of higher temperature fuels such as hydrogen.

In another non-limiting example, the central passage 202 exit can be truncated to the fuel nozzle cap 108, truncated at fuel nozzle lip 144, or can be truncated between the fuel nozzle cap 108 and the lip 144. It is also possible that central passage 202 can be extended aft of fuel nozzle lip 144. The passage of the central passage 202 can be made converging, constant area, or diverging to control velocity profile at exit of the central passage 202. If the central passage 202 is used as a pilot or diluent injection, flow through this circuit can be independently controlled for different operating cycles. The exit of the fuel nozzle lip 144 can also have features with constant area section followed by diverging section. It is contemplated that the central passage 202 can have nozzle cap with orifice holes either axial or tangential followed by a fuel nozzle lip. Instead of orifice holes, it is possible that the central passage 202 can have a swirler, such as a swirler vane, with a low swirl number ranging from 0 to 0.5, for example.

The radial placement of a splitter 216 can control flow area and velocity at exit of the swirler passage before air flow interacts with fuel flow. The radial location of the splitter 216 can be from 20% to 80% of the passage height H, which can be defined as the radial distance between a fuel nozzle 218 and a swirler outer wall 214. In one example, the splitter 216 can be positioned from 0.2H to 5H, while other or larger ranges are contemplated. Sufficient length is provided between an aft end of the splitter 216 and a fuel nozzle aft tip 220 so that wakes generated by the splitter 216 are reduced or eliminated before the air flow interacts with the fuel flow. The aft end of the splitter 216 can have sharp vertical or radial cut, slot, or recess to minimize splitter wake, or it can include a fillet to minimize wakes from the splitter 216.

Figure 6:
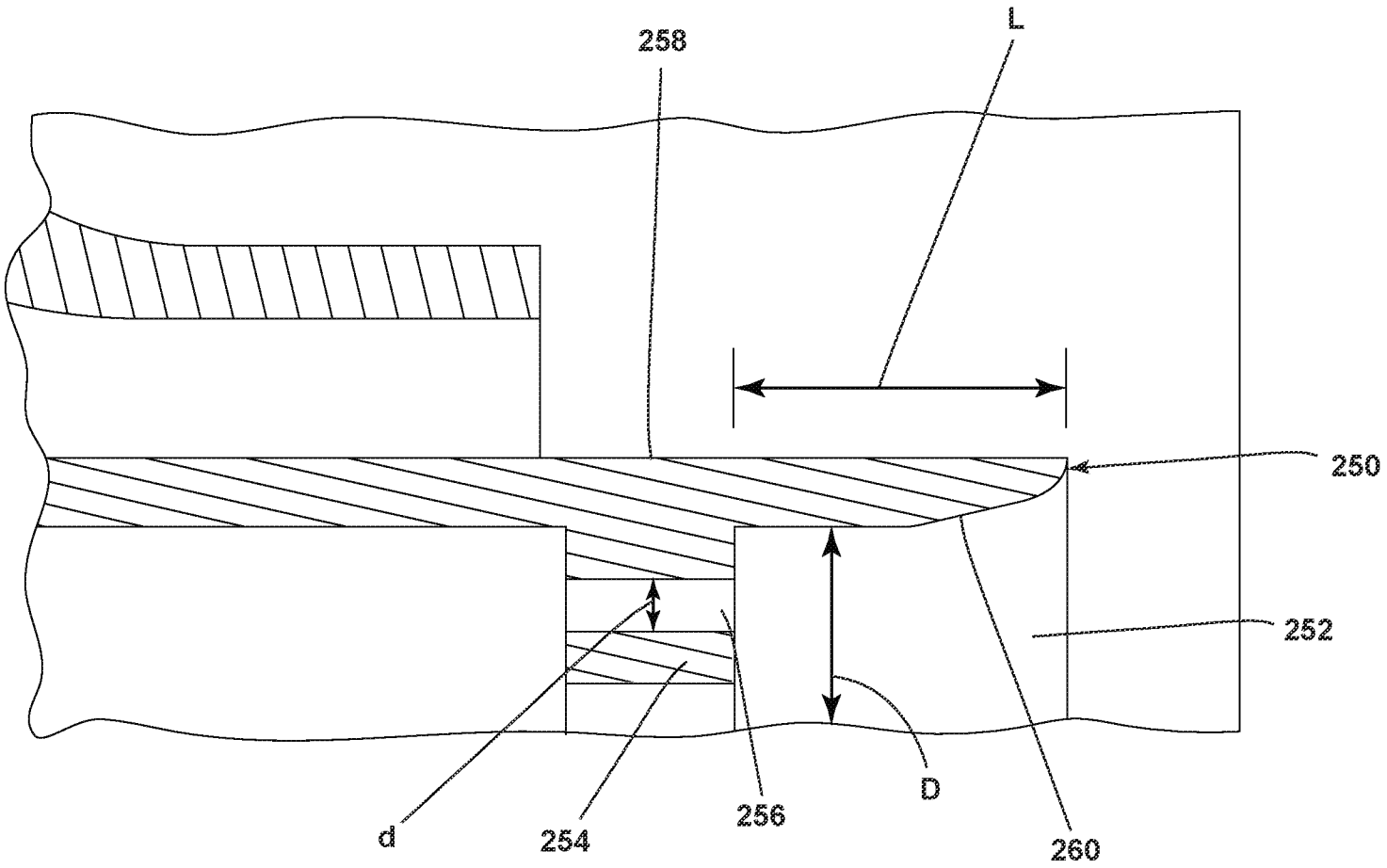
FIG. 6 is a cross section of an alternative outlet for a fuel nozzle in accordance with an exemplary embodiment of the present disclosure.

Turning to FIG. 6, an alternative nozzle tip 252 for a fuel nozzle 250 is provided downstream from a nozzle cap 254 with a diverging geometry. The nozzle tip 252 can be include a lip length L, defined along the fuel nozzle 250 from the nozzle cap 254 to the distal end of the nozzle tip 252. A diameter D can be defined as the diameter for the fuel nozzle 250, which increases as the nozzle tip 252 diverges at a diverging portion 260. While the diameter D is cut in the view shown in FIG. 6, it should be appreciated that the fuel nozzle 250 can be annular or cylindrical, defining the diameter D. An opening diameter d can be defined as the diameter for openings 256 provided in the nozzle cap 254. The ratio of the lip length L to the diameter of the openings d can be between zero to fifty (0-50), and the ratio of the lip length L to the nozzle diameter D can be between zero to five (0-5) in non-limiting examples, while wider ranges are contemplated. An outer surface 258 for the nozzle tip 252 can have a constant diameter to maintain high velocity on the exterior of the fuel nozzle 250. In one example, the fuel pressure ratio across the openings 256 can be from 1.0 to 1.4 for hydrogen fuels or hydrogen fuel blends, while other pressure ratios are contemplated based upon the particular fuel.

Figure 7:
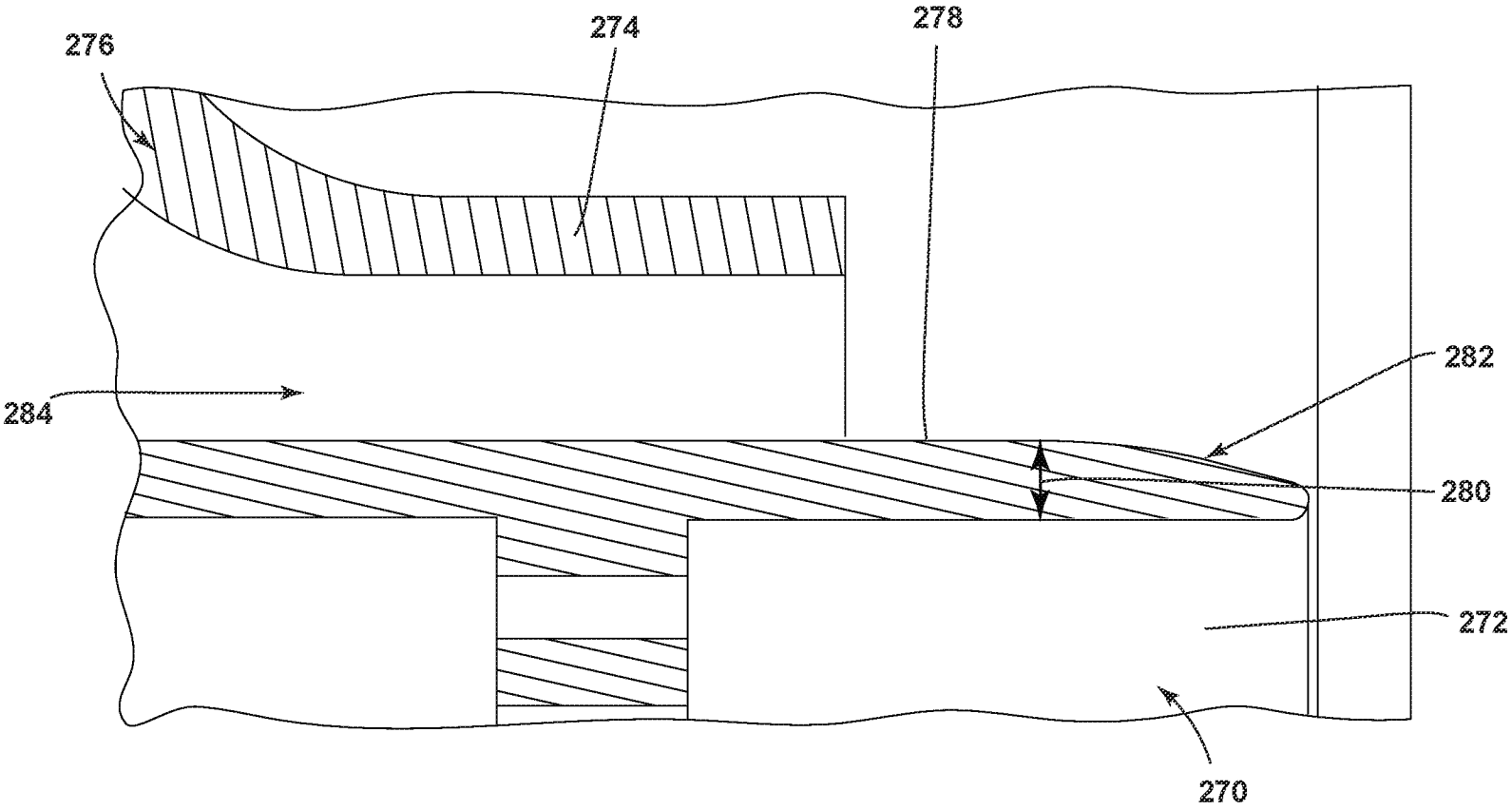
FIG. 7 is a cross section of another alternative outlet for a fuel nozzle in accordance with an exemplary embodiment of the present disclosure.

Turning to FIG. 7, another alternative nozzle tip 272 for a fuel nozzle 270 is provided downstream of a splitter 274 provided within an exterior swirler 276. An outer surface 278 of the nozzle tip 272 can be curved, defining a decreasing thickness 280 for the nozzle tip 272 extending aft, defining a diverging portion 282 for a radially outer swirler passage 284. The diverging portion 282 can begin aft of the splitter 274 in order to create a velocity profile for the air from the swirler 276 with a high axial velocity component prior to the diverging portion 282. The diverging portion 282 can provide for decreasing or eliminating the occurrence of recirculation zones or flame holding at the nozzle tip 272, as the inward curvature accelerates the air flow over the nozzle tip 272 to reduce or avoid flame holding on the nozzle tip 272.

Figure 8:
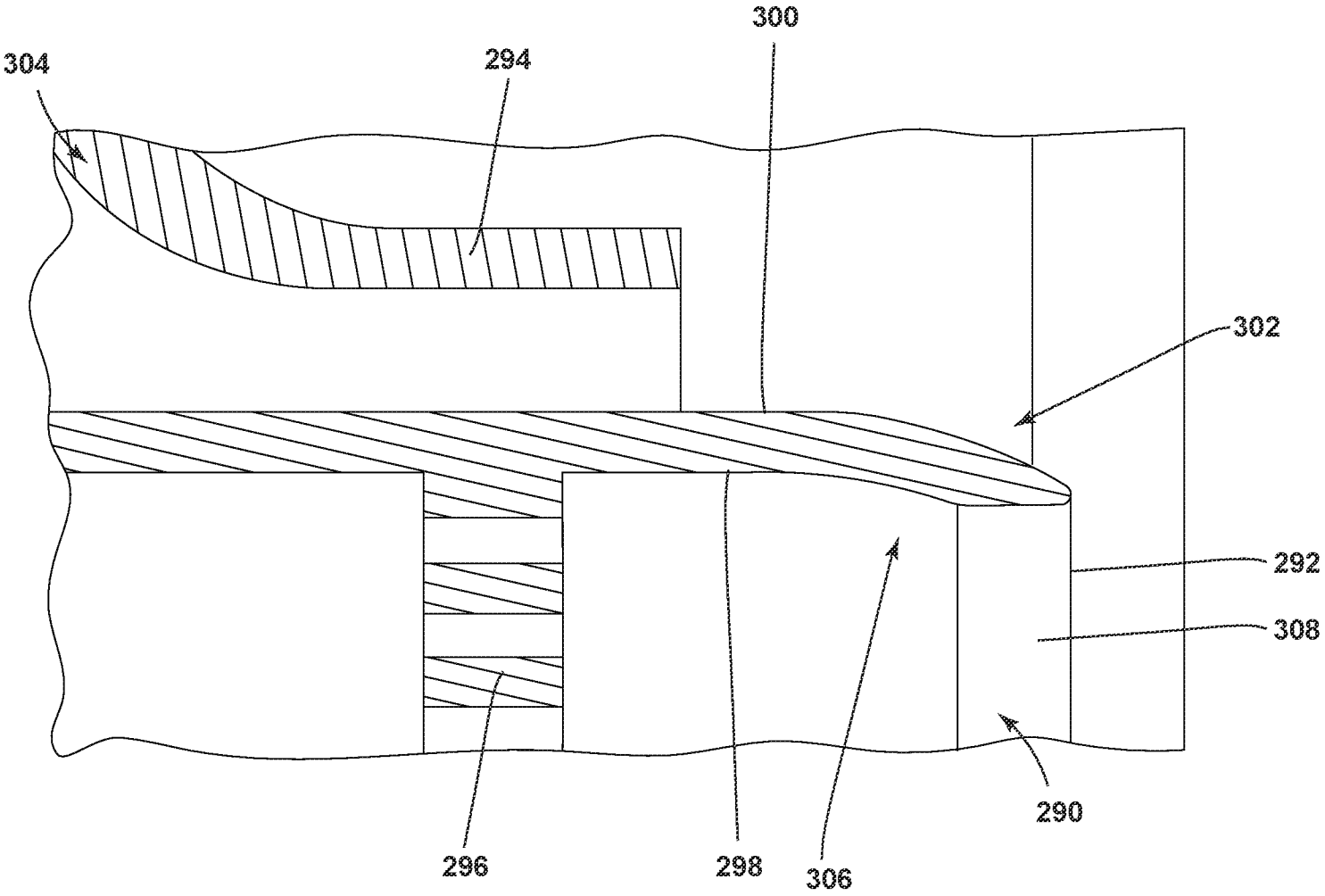
FIG. 8 is a cross section of yet another alternative outlet for a fuel nozzle in accordance with an exemplary embodiment of the present disclosure.

Turning to FIG. 8, another alternative nozzle tip 292 for a fuel nozzle 290 is provided downstream of a splitter 294 and a nozzle cap 296 contained within the fuel nozzle 290. The nozzle tip 292 includes an interior surface 298 and an exterior surface 300. The interior surface 298 and the exterior surface 300 can be curved such that a diverging passage 302 is defined for a swirler 304, and a converging passage 306 is defined for the fuel nozzle 290. The fuel nozzle 290 can include a circumferential tip portion 308 with a constant cross-sectional area, while it is contemplated that this portion is removed such that the fuel nozzle 290 terminates at the end of the curvature of the interior surface 298. The tip portion 308 can provide for improved velocity to eliminate flame holding, while eliminating the tip portion 308 can help reduce recirculation zones at the nozzle tip 292.

Figure 9:
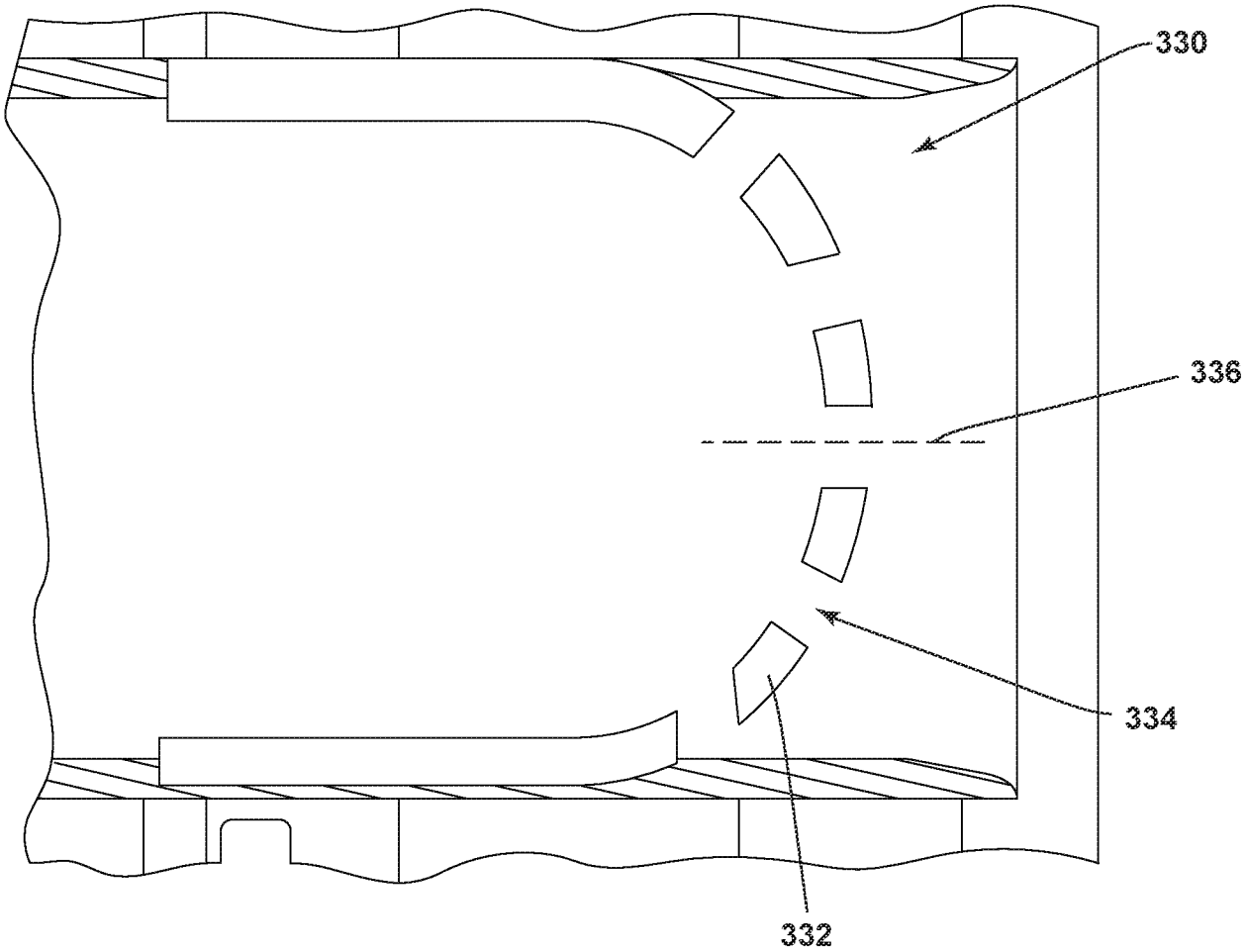
FIG. 9 is a cross section of an alternative, convex shape for a fuel nozzle in accordance with an exemplary embodiment of the present disclosure.

Turning now to FIG. 9, an alternative fuel nozzle 330 includes a nozzle cap 332 that is convex, relative to a flow of fuel through the fuel nozzle 330. The curvature for the nozzle cap 332, for example can be defined by a circular or elliptical profile, which can define a hemispherical or ellipsoidal shape for the nozzle cap 332, while other geometries are contemplated. Openings 334 are provided in the nozzle cap 332, which can be similar to the openings 140 as described herein, having an increasing swirling component nearer to the outer diameter of the fuel nozzle 330. Furthermore, a centerline 336 of the openings 334 can be oriented toward a center of the hemisphere or ellipsoid, or can be aligned axially relative to the fuel nozzle 330, in addition to or without imparting swirl to the fuel passing through the nozzle cap 332 with a tangential orientation for the openings 334. In this way, it should be appreciated that the openings 334 can be arranged axially, radially, tangential, or compounded angles formed as combinations thereof.

Figure 10:
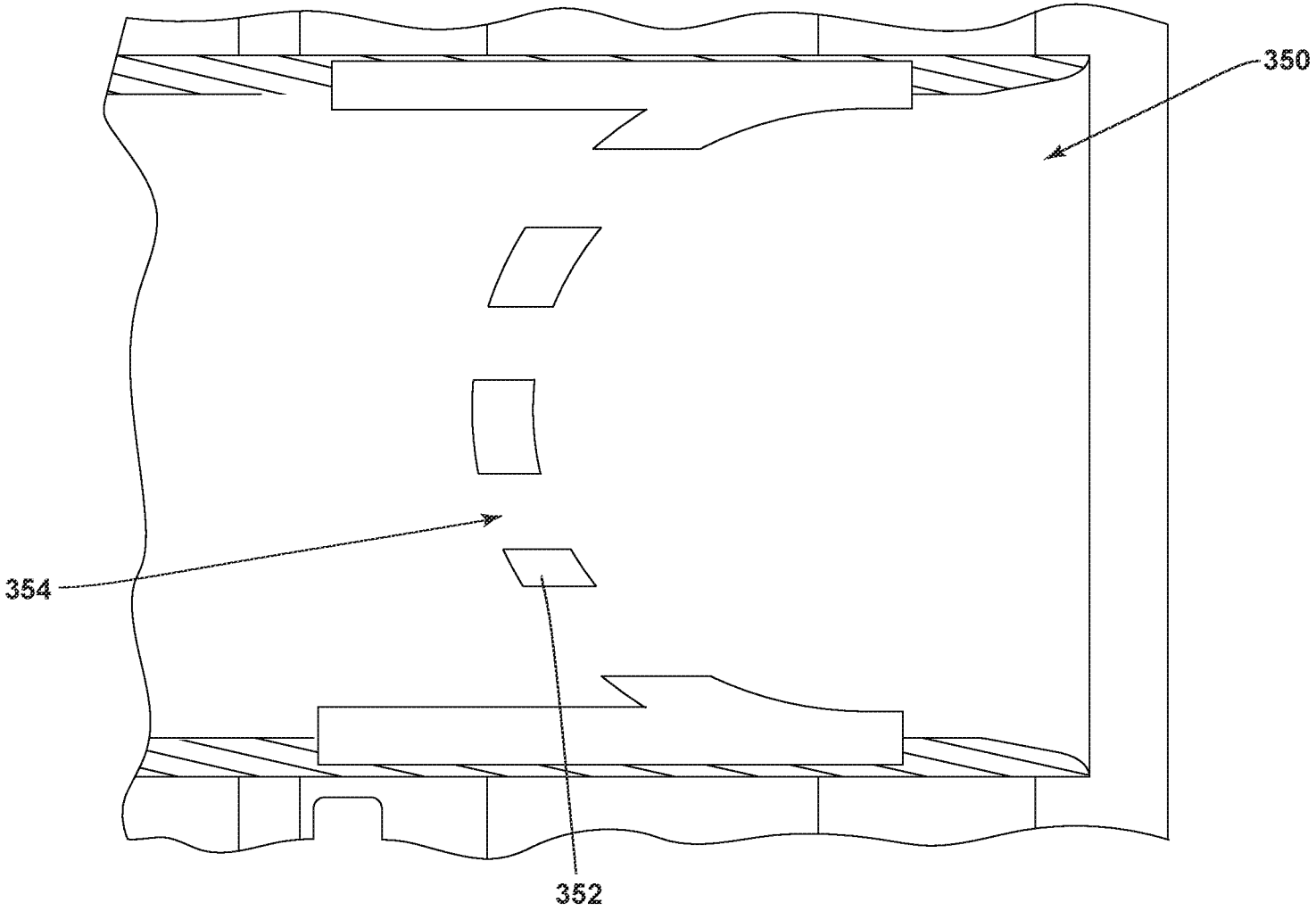
FIG. 10 is a cross section of an alternative, concave shape for a fuel nozzle in accordance with an exemplary embodiment of the present disclosure.

FIG. 10 shows another alternative fuel nozzle 350 that includes a nozzle cap 352 that is concave, relative to a flow of fuel through the fuel nozzle 350. Similar to that of FIG. 9, the curvature of the nozzle cap 352 can be hemispherical or ellipsoidal, while other geometries are contemplated. Additionally, openings 354 can be oriented relative to the nozzle cap 352, such as aligned with a center of a hemisphere or ellipsoid defined by the curvature of the nozzle cap 352, or arranged axially relative to the fuel nozzle 350. Additionally, the openings 354 can provide for imparting a swirl to the flow of fuel through the fuel nozzle 350, while it is contemplated that the openings 354 impart no swirl. Similar to FIG. 9, it should be appreciated that the openings 354 can be arranged axially, radially, tangential, or compounded angles formed as combinations thereof.

FIGS. 11-23 illustrate graphical plots showing a rate of swirl for an airflow provided by a swirler on the x-axis against a radial position on the y-axis. The dashed line positioned centrally represents a delineation between the fuel supply from the fuel nozzle and the air supply from the swirler, radially exterior of the fuel nozzle. More specifically, the amount or rate of swirl provided can be controlled based upon radial position, which can be defined by the swirler and the tangential openings in the fuel nozzle cap as described herein.

Figure 11:
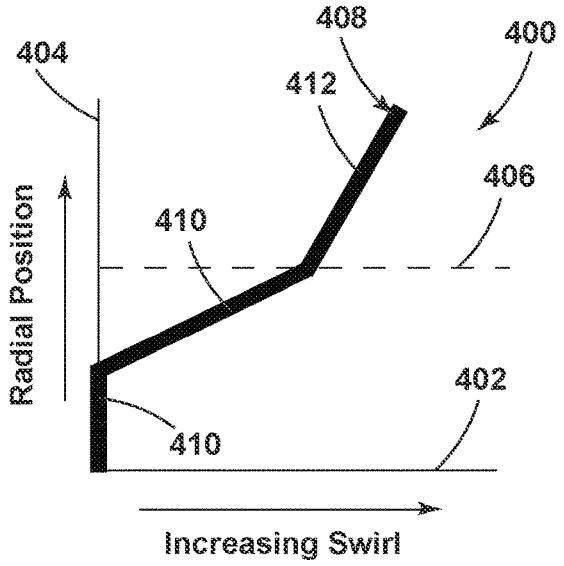
FIGS. 11-23 depict plots illustrating non-limiting exemplary embodiments showing the variation in the amount or rate of swirl provided by a fuel nozzle assembly in accordance with exemplary embodiments of the present disclosure.

FIG. 11 illustrates a graph 400 including an x-axis 402 representing an increasing rate of tangential swirl, and a y-axis 404 representing radial position, defined radially outward from a center of the fuel nozzle. A dashed line 406 represents the radial transition from the fuel nozzle to the radially exterior swirler.

As can be appreciated by a plot 408, the amount of swirl from the center of the fuel nozzle to about 50% of the radial extent of the fuel nozzle includes zero swirl, indicated at 410. The swirl defined in the outer 50% radial extent of the fuel nozzle, indicated at 412, can increase at a rate sufficient to be about the same as the rate of swirl at the radial interior of the swirler. The rate of swirl for the swirler, indicated at 412, can then further increase at a rate higher than the swirl of the fuel nozzle at 410, extending radially outward. Although 50% transitioning between axial to tangential direction of fuel is mentioned above, this transitioning can take place at any radial location of the fuel nozzle tip.

Having no swirl within the radial center of the fuel nozzle provides for positioning a recirculation bubble in the aft direction, which can be a recirculating flow of fuel resultant of the wake generated by the fuel, which reduces flame holding at the fuel nozzle. Increasing the rate of swirl for the fuel from no swirl to matching the swirl at the radial interior of the swirler provides for reducing shear between the two flows, as well as eliminating flame holding. Finally, increasing the tangential swirl in a radially-outward direction within the swirler provides for reducing flame holding on the flare cone.

It should be appreciated that the numbering, size, orientation, and placement of the openings in the fuel nozzle can be varied to achieve the desired velocity distribution at the fuel nozzle exit. Furthermore, the openings can vary in size to vary the fuel momentum profile at the nozzle exit. Such velocity distribution and momentum profiles can be tailored to the particular fuel nozzle assembly or engine to reduce recirculation, flame holding, or flashback.

Figure 12:
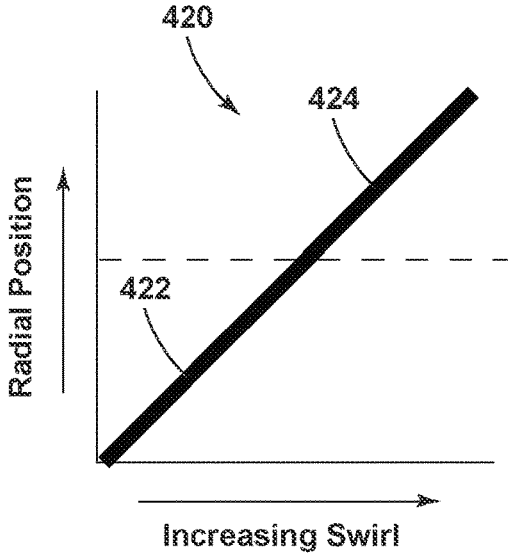

Referring to FIG. 12, another plot 420 illustrates a constant increase in rate of swirl for the fuel supply, indicated at 422, where the rate is zero at the center. The rate of swirl at where the fuel meets the air from the swirler, indicated at 424, can be similar to reduce shear between the two flows.

Figure 13:
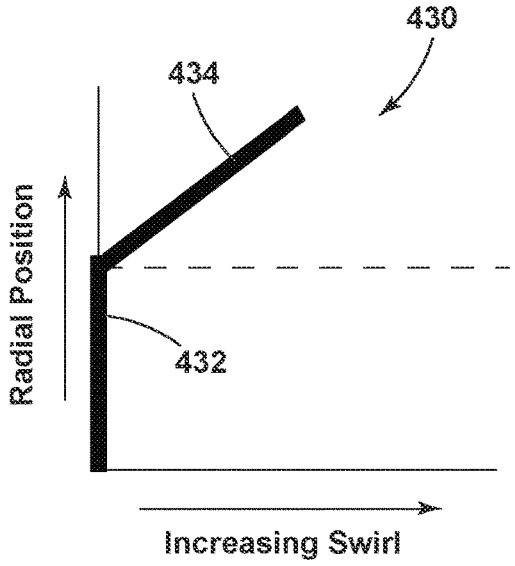

FIG. 13 shows another plot 430 which illustrates zero swirl for the fuel nozzle, indicated at 432. The rate of swirl for the swirler at the radial interior can be zero, matching that of the fuel nozzle, and then having the rate increase at a constant rate extending radially outward, indicated at 434. No swirl for the fuel nozzle and the swirler at the radial interior provides for reduced shear between the two flows, while increasing the velocity component of the fuel. Additionally, the higher swirler on the radial exterior of the swirler prevents flame holding on the flare cone.

Figure 14:
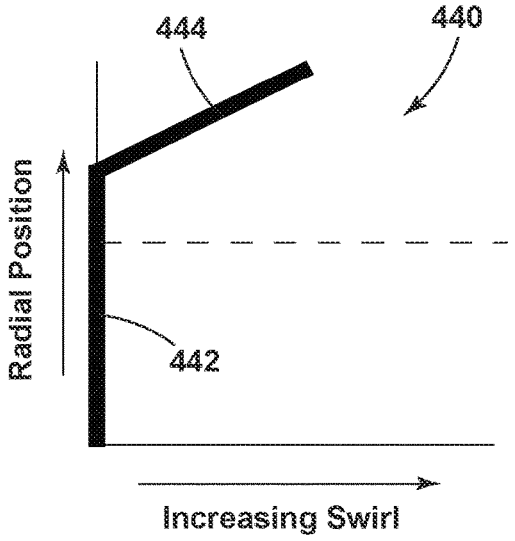

FIG. 14 shows an alternative arrangement for the plot 430 of FIG. 13, depicting a plot 440 where the zero-swirl extends into the swirler, such that the swirler includes no swirl on a radially interior portion, indicated at 442, and a swirling profile on a radially exterior portion, indicated at 444, which can be permitted by the splitter as described herein, separating the swirler into two flows.

Figure 15:
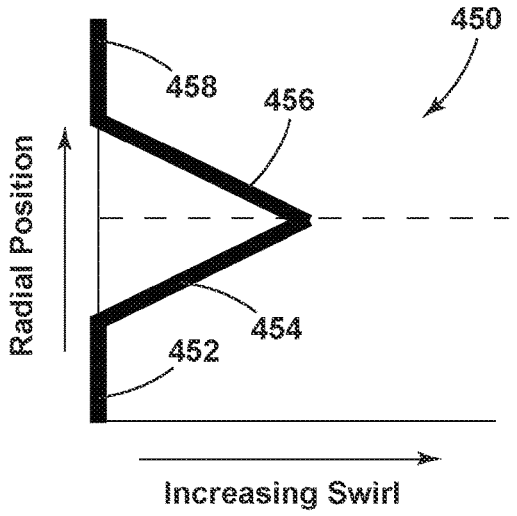

FIG. 15 shows yet another alternative plot 450, where the center of the fuel nozzle includes zero swirl, indicated at 452. The swirl for the radial exterior portion of the fuel nozzle can increase extending radially outward, indicated at 454. The swirl for the radially interior portion of the swirler, indicated at 456, can be the same as that of the radially-outer swirl from the fuel nozzle to reduce shear between the two flows. The swirl can then decrease to zero, indicated at 458. The zero flow at the fuel center pushes back the recirculation bubble, while the zero swirl at the radially outer portion can increase the velocity profile along the flare cone, which can reduce flame holding. This type of distribution is targeted for geometry with lower flare cone angle or no cylindrical flare.

Figure 16:
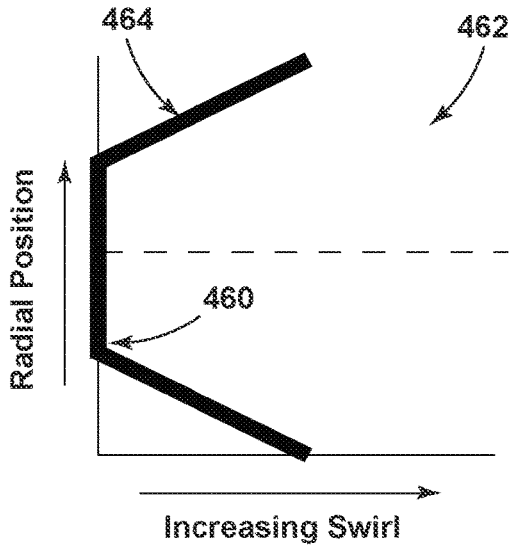

FIG. 16 shows yet another alternative plot 462, shows a non-zero swirl at a center of the fuel nozzle, decreasing radially outwardly to zero, indicated at 460 and staying at zero for a portion before reaching the radial exterior of the fuel nozzle. The swirler can then include zero swirl at the radial interior, to reduce shear between the two flows, with a radially-interior portion of the swirler including zero swirl, with increasing swirl extending radially outward in a radially-outer portion of the swirler, indicated at 464. The increased swirl at the radial exterior can provide to reduce flame holding along the flare cone.

Figure 17:
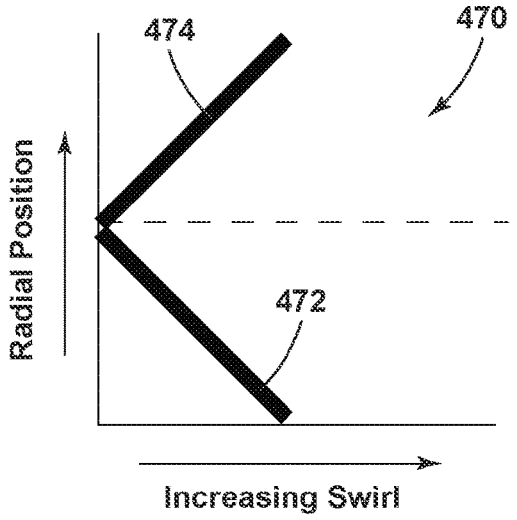

Referring now to FIG. 17, showing yet another alternative plot 470, shows a non-zero swirl at a center of the fuel nozzle, decreasing radially outwardly to zero swirl at the radial exterior of the fuel nozzle, indicated at 472. The swirler can then include zero swirl at the radial interior, to reduce shear between the two flows, with increasing swirl extending radially outward, indicated at 474. The increased swirl at the radial exterior can provide to reduce flame holding along the flare cone.

Figure 18:
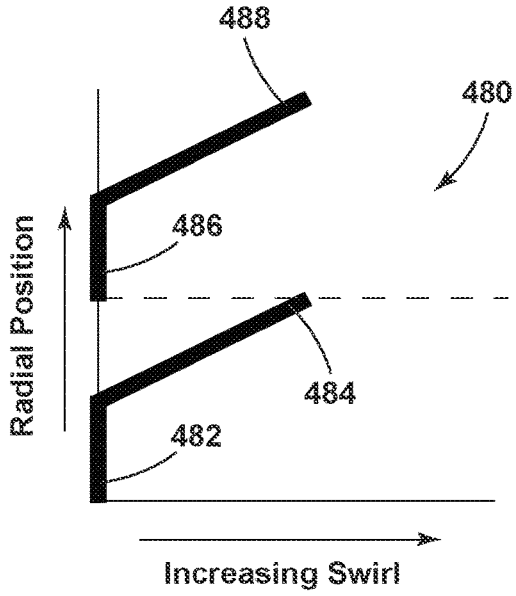

Referring now to FIG. 18, another plot 480 indicates a common distribution profile between the fuel nozzle and the swirler, where each includes a radially interior portion with zero swirl, indicated at 482 and 486. A radially exterior portion for each of the fuel nozzle and swirler can include an increasing swirl from zero, extending radially outward, indicated at 484 and 488.

Figure 19:
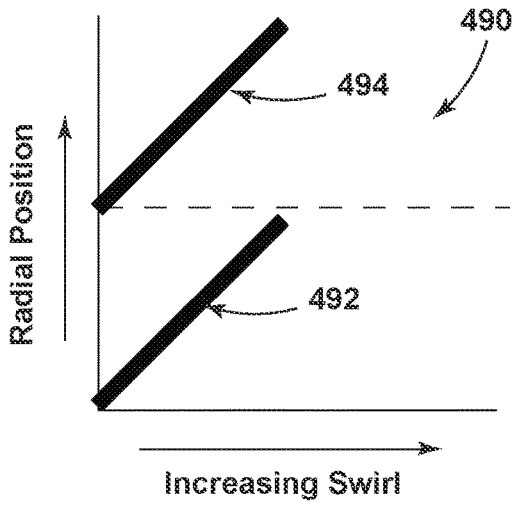

FIG. 19 shows another plot 490 with another common distribution profile between the fuel nozzle and the swirler, with each increasing from zero swirl extending radially outward, indicated at 492 and 494 respectively.

Figure 20:
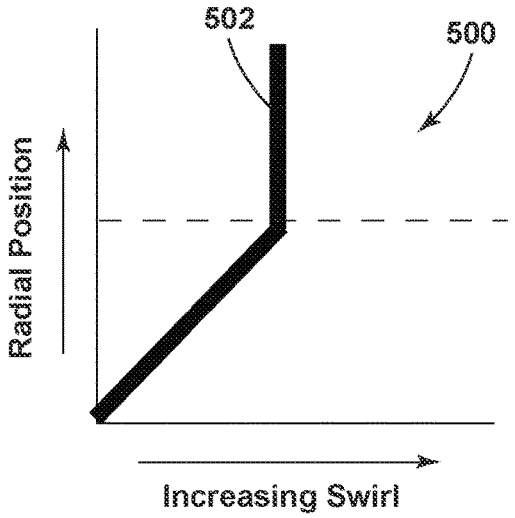

FIG. 20 shows yet another plot 500. The fuel nozzle can have increasing swirl, from zero swirl at the center, increasing radially outward, indicated at 502. The swirl in the swirler can be constant and non-zero, which can be the same as the swirl at the radial exterior of the fuel nozzle to reduce shear between the two flows.

Figure 21:
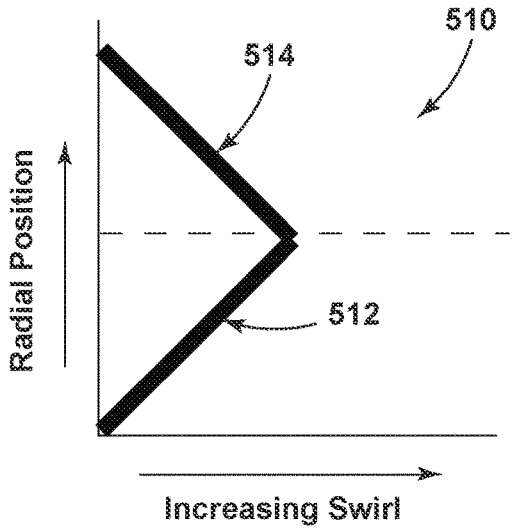

FIG. 21 shows yet another plot 510 where the fuel nozzle swirl increases from zero extending radially outward at a constant rate, indicated at 512. The swirl at the radial interior of the swirler can be the same as at of the fuel nozzle at the radial exterior, such that the shear between the two flows is reduced. The swirl in the swirler can then decrease to zero extending in the radially-outward direction, indicated at 514.

Figure 22:
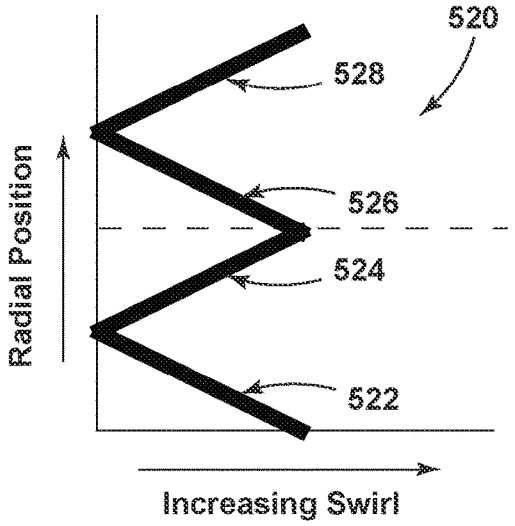

FIG. 22 shows another plot 520 with common profiles for the fuel nozzle and the swirler. Each includes a non-zero swirler at the radial interior, or the center of the fuel nozzle, decreasing to zero swirl, indicated at 522 and 524. Then, each includes a portion that increases from zero to match the swirl at the radial interior, indicated at 526 and 528. In this way, shear is reduced between the fuel nozzle and the swirler, while defining variable profiles to reduce or eliminate flame holding.

Figure 23:
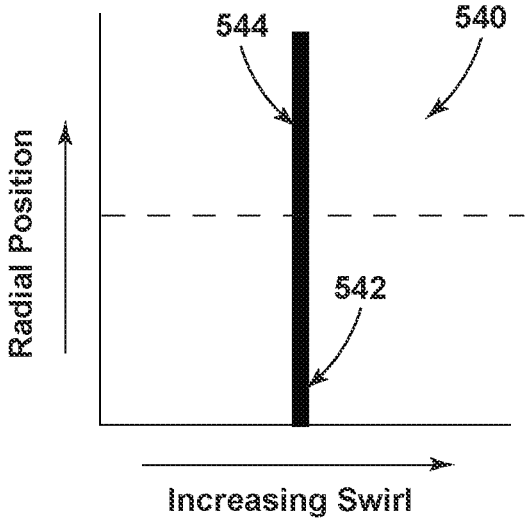

FIG. 23 shows another plot 540, where both the fuel nozzle and the swirler include a constant, non-zero swirl, indicated at 542 and 544, which can reduce shear between the two flows.

It should be appreciated that while each profile in FIGS. 11-23 is shown as linear, or constant, that non-constant rates of change in the swirl, in the radial direction, an be non-constant, such that the plots are curved, while constant and non-constant combinations are contemplated as well.

It should be further appreciated that varying the rate of swirl for the fuel flow from the fuel nozzle and the air flow from the swirler can be utilized to develop complex velocity profiles, which can be tailored to reduce or eliminate flame holding, flashback, and recirculation at various radial positions for the fuel nozzle assembly, which can provide for the use of faster-burning or higher-temperature fuels, such as hydrogen or hydrogen mixes.

Furthermore, it should be appreciated that fuel swirl or tangential angle of the holes should to be gradually increased to reduce or avoid flame on the fuel nozzle lip. Average swirl from fuel circuit at nozzle tip can be from 0 to 1.5, and average swirl from swirler air circuit exit, before it interacts with fuel, can be from 0 to 1.5. Reducing the shear between the swirler air circuit and fuel nozzle provides for a consistent velocity profile, which reduces flame holding on the hardware downstream.

Further, it can be desirable the fuel nozzle tangential velocity can be gradually increased to reduce a sudden deficit in velocity, pressure, or flow condition leading to high shear layer with fuel passage downstream fuel nozzle. Similarly, air flow velocity has to be well controlled to reduce flame holding on the swirler component like splitter, swirler outer wall, swirler inner wall, and flare cone.

It should be appreciated that the aspects and embodiments provided herein are not limited to those embodiments as shown. More specifically, one or more aspects of one embodiment can be combined with, interchanged with, or removed from one or more of the other embodiments, such that additional embodiments are contemplated within the scope of this disclosure by a person having ordinary skill in the art, while not explicitly shown.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects are provided by the subject matter of the following clauses, a turbine engine comprising a turbine engine comprising: a compressor section, combustor section, and turbine section in serial flow arrangement, with the combustor section including a fuel nozzle assembly comprising: a fuel nozzle defining a longitudinal axis and a radial axis orthogonal thereto, and the fuel nozzle including a fuel passage terminating at an outlet, the fuel nozzle including nozzle tip; and a nozzle cap including a set of openings and provided within the fuel passage; wherein at least one opening of the set of openings is has a centerline oriented at a tangential angle relative to the radial axis.

The turbine engine of any preceding clause, wherein the set of openings are arranged into rows defined circumferentially relative to the longitudinal axis.

The turbine engine of any preceding clause, wherein the tangential angle for the rows of openings increases as a radial distance from the longitudinal axis increases.

The turbine engine of any preceding clause, wherein the tangential angle for an opening of the set of openings at a center of the nozzle cap is zero.

The turbine engine of any preceding clause, further comprising a nozzle lip defined between the nozzle cap and the nozzle tip.

The turbine engine of any preceding clause, wherein the nozzle lip includes an axial portion and a diverging portion.

The turbine engine of any preceding clause, wherein the nozzle tip defines a lip length and the fuel nozzle defines a diameter, and a ratio of lip length to diameter is between zero and five.

The turbine engine of any preceding clause, wherein the nozzle tip defines a lip length and each opening of the set of openings defines an opening diameter, and a ratio of lip length to opening diameter is between zero and fifty.

The turbine engine of any preceding clause, wherein the nozzle lip includes a diverging portion defined on an exterior surface of the fuel nozzle.

The turbine engine of any preceding clause, wherein the nozzle lip further includes a diverging portion defined on an interior surface of the fuel nozzle.

The turbine engine of any preceding clause, wherein the nozzle cap is curved as concave or convex relative to a flow direction through the fuel passage.

The turbine engine of any preceding clause, further comprising a central passage extending within the fuel passage and extending through the nozzle cap.

A fuel nozzle and swirler assembly for an engine, the fuel nozzle and swirler assembly comprising: a fuel nozzle defining a longitudinal axis and a radial axis orthogonal to the longitudinal axis; a swirler circumscribing the fuel nozzle, the swirler including a set of vanes to impart a tangential component, tangent to the radial axis, to a fluid passing through the swirler; and a splitter, extending aft from the set of vanes, separating the swirler into a radially outer passage and a radially inner passage.

The fuel nozzle and swirler assembly of any preceding clause, wherein the splitter is arranged parallel to the fuel nozzle.

The fuel nozzle and swirler assembly of any preceding clause, wherein the radially outer passage and the radially inner passage are coaxial with the fuel nozzle.

The fuel nozzle and swirler assembly of any preceding clause, wherein the fuel nozzle further includes a nozzle cap with a set of openings extending through the nozzle cap, with at least some openings of the set of openings arranged at a tangential angle relative to a radius defined relative to the longitudinal axis.

A method providing fuel and air to a combustor for a turbine engine, providing a supply of fuel via a fuel nozzle defining a longitudinal axis, and a supply of air via a swirler circumscribing the fuel nozzle, the method comprising: imparting a tangential component, tangent to a radius extending from the longitudinal axis, to the supply of fuel with a set of openings provided in a nozzle cap arranged at a tangential angle.

The method of any preceding clause, wherein the tangential component imparted to the supply of fuel is complementary to a swirl imparted by the swirler to the supply of air.

The method of any preceding clause, wherein the swirler includes a splitter, separating the supply of air into a radially inner supply and a radially outer supply, and the tangential component imparted to the supply of fuel is complementary to the swirl imparted to the radially inner supply.

The method of any preceding clause, wherein the tangential component imparted to the supply of fuel is counter rotating relative to the supply of air provided by the swirler.

We claim:

1. A turbine engine comprising:

a compressor section, a combustor section, and a turbine section in serial flow arrangement, with the combustor section including a fuel nozzle assembly comprising:

a fuel nozzle defining a longitudinal axis and a radial axis orthogonal thereto, the fuel nozzle comprising:

a fuel passage terminating at an outlet, the fuel nozzle including a nozzle tip coaxial with the longitudinal axis, the fuel passage configured to exhaust a flow of fuel through the outlet;

a swirler configured to feed a swirled flow of compressed air that is mixed with the flow of fuel downstream of the outlet;

nozzle cap provided within the fuel passage to receive the flow of fuel therefrom, the nozzle cap including a set of openings to supply the flow of fuel therethrough, the set of openings arranged into a plurality of rows defined circumferentially relative to and spaced from the longitudinal axis, the plurality of rows having a first portion of rows of the plurality of the rows arranged in an area within an inner fifty percent of a radial extent of the nozzle cap, and a second portion of rows of the plurality of rows arranged in an area within an outer fifty percent of the radial extent of the nozzle cap;

wherein at least one opening in each row of the set of openings has a centerline oriented at a tangential angle relative to the radial axis, wherein the tangential angle of the at least one opening in each row of the plurality of rows arranged within the outer fifty percent of the radial extent of the nozzle cap increases as a radial distance from the longitudinal axis increases; and a nozzle lip defined between the nozzle cap and the nozzle tip, coaxial with the fuel nozzle including an axial portion and a diverging portion extending from the axial portion, the axial portion defining a constant cross-sectional area downstream of the fuel nozzle cap coaxial with the fuel nozzle, and the diverging portion defining an increasing cross-sectional area coaxial with the fuel nozzle;

wherein:

the at least one opening in each row of the plurality of rows arranged within the inner fifty percent of the radial extent of the nozzle cap imparts no swirl motion to the fuel exiting the set of openings to form a no swirl flow of fuel;

the at least one opening in said each row of the plurality of rows arranged within the outer fifty percent of the radial extent of the nozzle cap imparts a swirl motion to the fuel exiting the at least one opening in said each row of the plurality of rows arranged within the outer fifty percent of the radial extent of the nozzle cap to form a swirling flow of fuel;

the no swirl flow of fuel and the swirling flow of fuel collectively form the flow of fuel that is exhausted through the outlet such that the flow of fuel has an average swirl of greater than 0 and less than 1.5.

2. The turbine engine of claim 1, wherein the tangential angle for an opening of the set of openings at a center of the nozzle cap is ninety degrees.

3. The turbine engine of claim 1, wherein the nozzle tip defines a lip length and the fuel nozzle defines a nozzle diameter, and a ratio of the lip length to the nozzle diameter is between zero and five.

4. The turbine engine of claim 1, wherein the nozzle tip defines a lip length and each opening of the set of openings defines an opening diameter, and a ratio of the lip length to the opening diameter is between zero and fifty.

5. The turbine engine of claim 1, wherein the nozzle lip includes a diverging portion defined on an exterior surface of the fuel nozzle.

6. The turbine engine of claim 5, wherein the nozzle lip further includes a diverging portion defined on an interior surface of the fuel nozzle.

7. The turbine engine of claim 1 wherein the nozzle cap is curved as concave or convex relative to a flow direction through the fuel passage.

8. The turbine engine of claim 1 further comprising a central passage extending within the fuel passage and extending through the nozzle cap.

9. The turbine engine of claim 1 wherein the set of openings lie in a common plane.

10. The turbine engine of claim 1 wherein said at least one opening of the plurality of rows arranged within the inner fifty percent of the radial extent of the nozzle cap has a smaller cross-sectional area than said at least one opening of the plurality of rows arranged in an area within the outer fifty percent of the radial extent of the nozzle cap.

11. The turbine engine of claim 1, wherein the swirler is located radially outward from the fuel passage, with respect to the longitudinal axis.

12. The turbine engine of claim 11, wherein the fuel nozzle comprises an inner supply, with the fuel passage being located radially between the inner supply and the swirler.

13. A turbine engine comprising:

a compressor section, a combustor section, and a turbine section in serial flow arrangement, with the combustor section including a fuel nozzle assembly comprising:

a fuel nozzle defining a longitudinal axis and a radial axis orthogonal thereto, the fuel nozzle comprising:

a fuel passage terminating at an outlet, the fuel nozzle including a nozzle tip coaxial with the longitudinal axis, the fuel passage configured to exhaust a flow of fuel through the outlet;

a swirler configured to feed a swirled flow of compressed air that is mixed with the flow of fuel downstream of the outlet; and a nozzle cap provided within the fuel passage to receive the flow of fuel therefrom, the nozzle cap including a plurality of openings to supply the flow of fuel therethrough, the plurality of openings arranged into a plurality of rows defined circumferentially relative to and spaced from the longitudinal axis, wherein:

each opening of the plurality of openings has a respective centerline;

the respective centerline of each opening of a first portion of the openings of the plurality of openings forms a respective non-zero tangential angle with respect to the radial axis such that the flow of fuel emitted from the outlet has a non-zero tangential momentum;

the respective non-zero tangential angle of a first opening provided within a first row of the plurality of rows, is smaller than the respective non-zero tangential angle of a second opening provided within a second row of the plurality of rows;

wherein the respective non-zero tangential angle of said each opening of the first portion of the openings serially increases between rows of the plurality of rows radially between the first row and the second row;

the first row is located radially inward from the second row, with respect to the longitudinal axis; and the non-zero tangential angle of at least the first opening and the second opening is configured to produce a swirled motion of fuel, such that the flow of fuel exhausted form the outlet has an average swirl of greater than 0 and less than or equal to 1.5.

14. The turbine engine of claim 13, wherein the respective centerline of a second portion of the openings of the plurality of openings form a respective tangential angle with respect to the radial axis that is ninety degrees.

15. The turbine engine of claim 14, wherein: the first portion of the openings are located within a first region of the nozzle cap extending from greater than or equal to 50% to less than or equal to 100% of a radial extent of the nozzle cap, with respect to the longitudinal axis; and the second portion of the openings are located within a second region of the nozzle cap extending from greater than or equal to 0% to less than 50% of the radial extent of the nozzle cap.

16. The turbine engine of claim 13, wherein:

the respective non-zero tangential angle of a third opening provided within a third row of the plurality of rows is larger than the respective non-zero tangential angle of the first opening, and smaller than the respective non-zero tangential angle of the second opening.

17. The turbine engine of claim 16, wherein the third row is located radially between the first row and the second row, with respect to the longitudinal axis.

18. The turbine engine of claim 13, wherein the first row and the second row each comprise two or more openings having the same respective tangential angle.

19. The turbine engine of claim 13, wherein the flow of fuel contains a hydrogen fuel.

* * * * *